United States Patent [19]

Ward, Jr. et al.

[11] Patent Number: 4,500,243

[45] Date of Patent: Feb. 19, 1985

[54] BLANK STACKING APPARATUS

[75] Inventors: Henry D. Ward, Jr., Cockeysville; John B. West, Glyndon, both of Md.

[73] Assignee: The Ward Machinery Company, Cockeysville, Md.

[21] Appl. No.: 472,855

[22] Filed: Mar. 7, 1983

[51] Int. Cl.[3] ..... B65G 57/04; B65H 31/32

[52] U.S. Cl. ..... 414/50; 271/197; 271/218; 271/224; 414/73; 414/900

[58] Field of Search ..... 414/43, 50, 72, 73, 414/75, 900; 271/193, 196, 197, 218, 224

[56] References Cited

U.S. PATENT DOCUMENTS

| | | | |
|---|---|---|---|
| 2,205,767 | 6/1940 | Lamb | 271/218 X |
| 2,895,552 | 7/1959 | Pomper et al. | 271/197 X |
| 3,022,999 | 2/1962 | Mead | 271/224 |
| 3,263,827 | 8/1966 | Verrinder | 414/43 |
| 3,362,707 | 1/1968 | Lauren | 271/218 |
| 3,477,711 | 11/1969 | Lyman | 271/197 |
| 3,698,708 | 10/1972 | Brawn | 414/73 X |
| 3,820,779 | 6/1974 | Bishop | 271/197 X |
| 3,892,168 | 7/1975 | Grobman | 414/50 X |
| 4,324,522 | 4/1982 | Buccicone | 414/51 |

FOREIGN PATENT DOCUMENTS 2062370 6/1972 Fed. Rep. of Germany ..... 414/73

*Primary Examiner*—Leslie J. Paperner

*Attorney, Agent, or Firm*—Boyce C. Dent

[57] ABSTRACT

Apparatus for stacking paperboard blanks including a timed conveyor utilizing vacuum pressure to hold the blanks by their leading edges beneath the conveyor and serially advance them against a backstop whereupon they are released by the vacuum to settle upon an elevator which lowers incrementally as a stack of blanks is formed thereon. When the stack is completed, interrupter tines move over the stack and under the conveyor to store oncoming blanks while the stack is discharged from the elevator after which is rises. As the tines withdraw, the stored blanks settle on the elevator and subsequent blanks form another stack. A counter is used to energize operation of the tines to form stacks of a predetermined number of blanks on the elevator. An inclined conveyor utilizing vacuum belts is used to feed the blanks into engagement with the timed conveyor.

24 Claims, 18 Drawing Figures

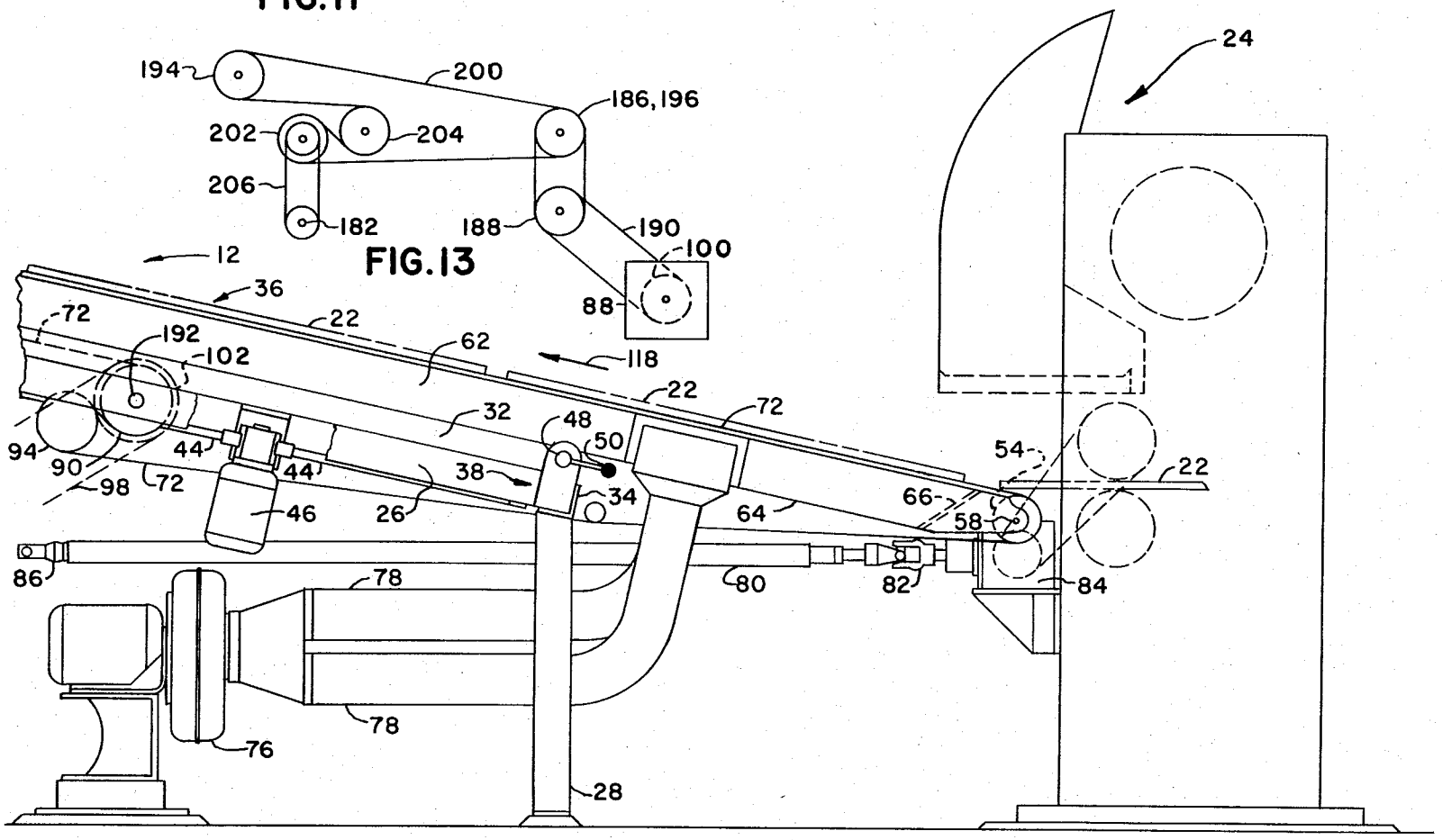
FIG. 2
FIG. 13
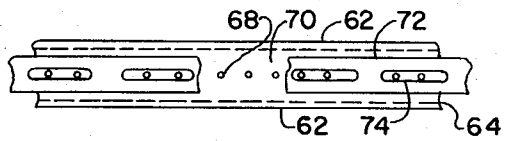
FIG. 11

BLANK STACKING APPARATUS

SUMMARY OF THE INVENTION

It is an object of this invention to provide a stacking apparatus for corrugated and solid fibre paperboard blanks of regular or irregular shape which will result in even stacks of such blanks. More particularly, another object is to provide even stacks of die cut blanks which previously have been stacked with great difficulty. A still further object is to serially advance such blanks in a timed sequence beneath a vacuum belt to deposit them in an even stack on top of an elevator. The foregoing and further objects and novel features are generally accomplished by the invention as summarized below. Apparatus for stacking paperboard blanks, particularly irregular-shaped die cut blanks, including timed conveyor belts through which suction pressure is applied to hold the leading edges of the blanks against the lower runs of the belts to advance them serially against individually adjustable backstops, positioned to engage irregular-shaped leading edges on the blanks, whereupon the leading edges are released from the suction pressure permitting the blanks to settle upon an elevator which lowers incrementally to form a stack of blanks thereon. When the stack is completed, interrupter tines move over the stack and beneath the timed conveyor belts to store subsequently released blanks while the stack is discharged by driven rollers on the elevator after which it rises to its starting position. The tines are withdrawn and the blanks stored thereon settle onto the elevator to form a new stack with blanks subsequently released by the timed conveyor belts. A counter is used to energize operation of the tines to form stacks of a predetermined number of blanks on the elevator. An inclined conveyor is used to serially advance the blanks into contact with the timed conveyor belts. The inclined conveyor includes conveyor belts through which suction pressure is applied to hold the blanks firmly on the upper runs of the belts during advancement to the timed conveyor belts.

Side spankers are provided alongside the top of the stack being formed to align the side edges of the blanks in the stack. A fixed trailing edge backstop forms a hopper with the side spankers and the previously mentioned leading edge backstops to form evenly aligned stack of blanks on the elevator.

The circumference of the timed conveyor belts is preferably twice the maximum length of blanks to be stacked and include two arrays of vacuum ports spaced equidistant around the circumference of the belts. The conveyor belts are timed to bring the first array of holes into contact with the leading edges of the first blank supplied from the inclined conveyor and the second array into contact with the second blank. In this manner, each blank is advanced beneath the lower run of the conveyor belts until the belts turn around the tail pulley of the conveyor which breaks the vacuum connection with the blank; the backstops are positioned to stop the advance of the blanks when the vacuum connection is broken so that the blanks settle upon the elevator.

If desired, the circumference of the conveyor belts may be twice the maximum length of blanks with three arrays of vacuum ports spaced equidistant around the circumference. With this arrangement, blanks two-thirds the maximum length to be stacked can be advanced by the belts with the required timing. If blanks longer than two-thirds of the maximum length are to be stacked, they may be triple fed, that is, one blank for every third feed cycle is supplied to the inclined conveyor.

If desired, the interrupter tines may be omitted and, instead, the supply of blanks to the stacker interrupted during such time that the stack of blanks on the elevator is being discharged. This may be accomplished by electrically engerizing a conventional stop feed mechanism, on the box machine supplying the blanks, in response to the stack of blanks on the elevator reaching a predetermined height or in response to the number of blanks on the elevator reaching a predetermined number.

DESCRIPTION OF THE DRAWINGS

FIG. 2 is a schematic illustration in side elevation of the inclined conveyor for advancing blanks to the timed conveyor of FIG. 1;

FIG. 11 is a top view of a portion of one of the inclined conveyor assemblies of FIG. 2;

FIG. 13 is a schematic illustration of the drive train from the box machine for the inclined conveyor and timed conveyor assemblies of FIG. 1;

DESCRIPTION OF THE PREFERRED EMBODIMENT

Figure 1:
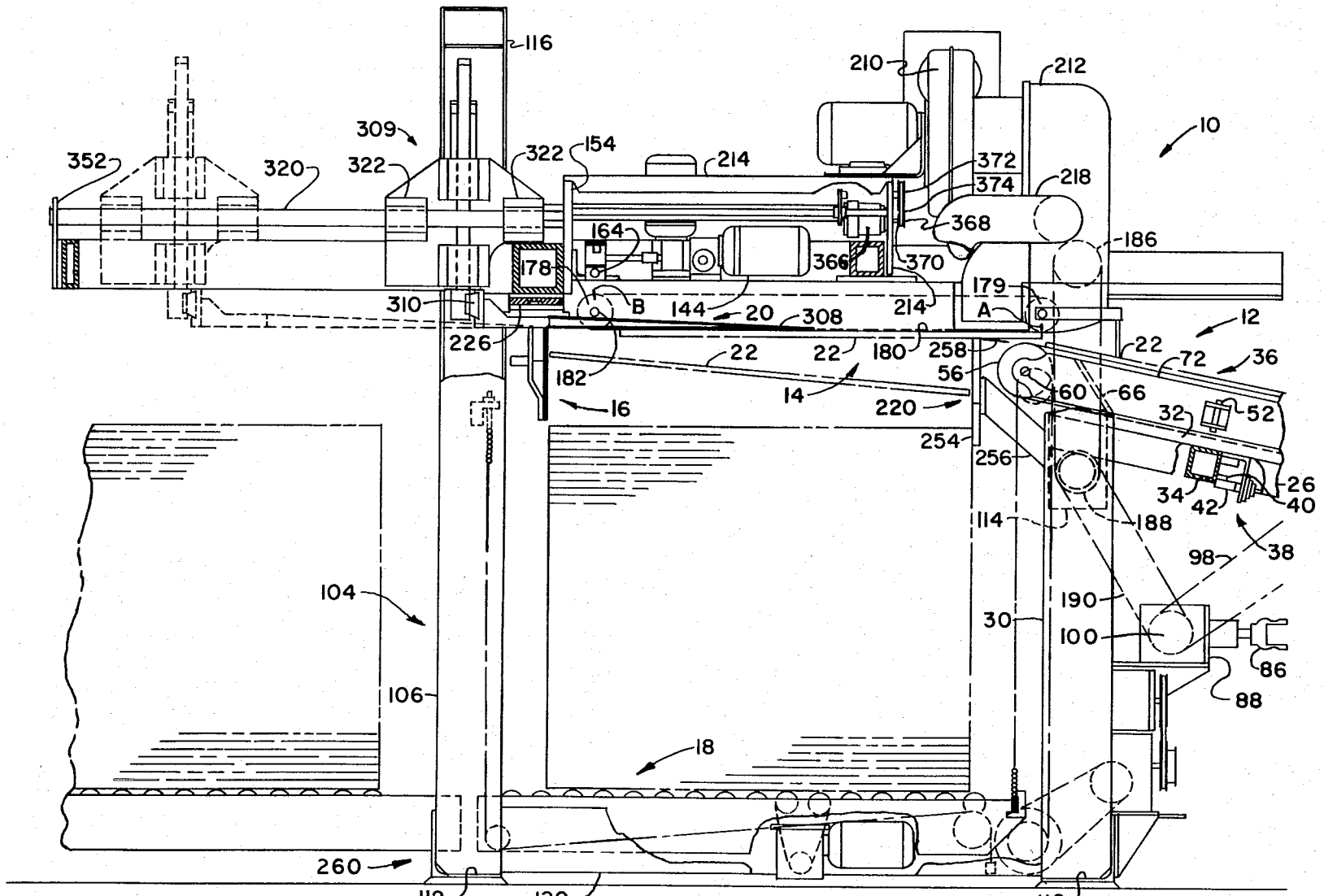
FIG. 1 is a schematic illustration in side elevation showing the timed conveyor, backstop, elevator, and interrupter assemblies.

FIGS. 1 and 2 taken together show the main assemblies of the stacking apparatus 10 which includes an inclined conveyor assembly 12, a timed conveyor assembly 14, a backstop assembly 16, an elevator assembly 18, and an interrupter assembly 20.

A supply of blanks 22 is provided by a conventional blank finishing machine 24 to the inclined conveyor 12. Such blanks are discharged serially from machine 24 with a space between them that depends on the length of the blanks being processed as well understood by those skilled in the art. For example, if the nominal size of the machine is 66 inches, the maximum length blank will be about 64 inches with a 2 inch space between each blank. Since the machine processes 1 blank for each feed cycle of 66 inches, then, if a blank of 44 inches (⅔ the maximum nominal sheet length) is processed, there will be a space of 22 inches between blanks. Thus, it can be said that the blanks advance serially in timed sequence.

Since the stacking apparatus 10 is a timed apparatus, it is important that the blanks advance in the timed sequence provided by the machine 24. This is accomplished by driving both the inclined conveyor 12 and timed conveyor 14 from the machine 24 and utilizing a vacuum, that is, suction pressure, to control the advance of the blanks.

Figure 5:
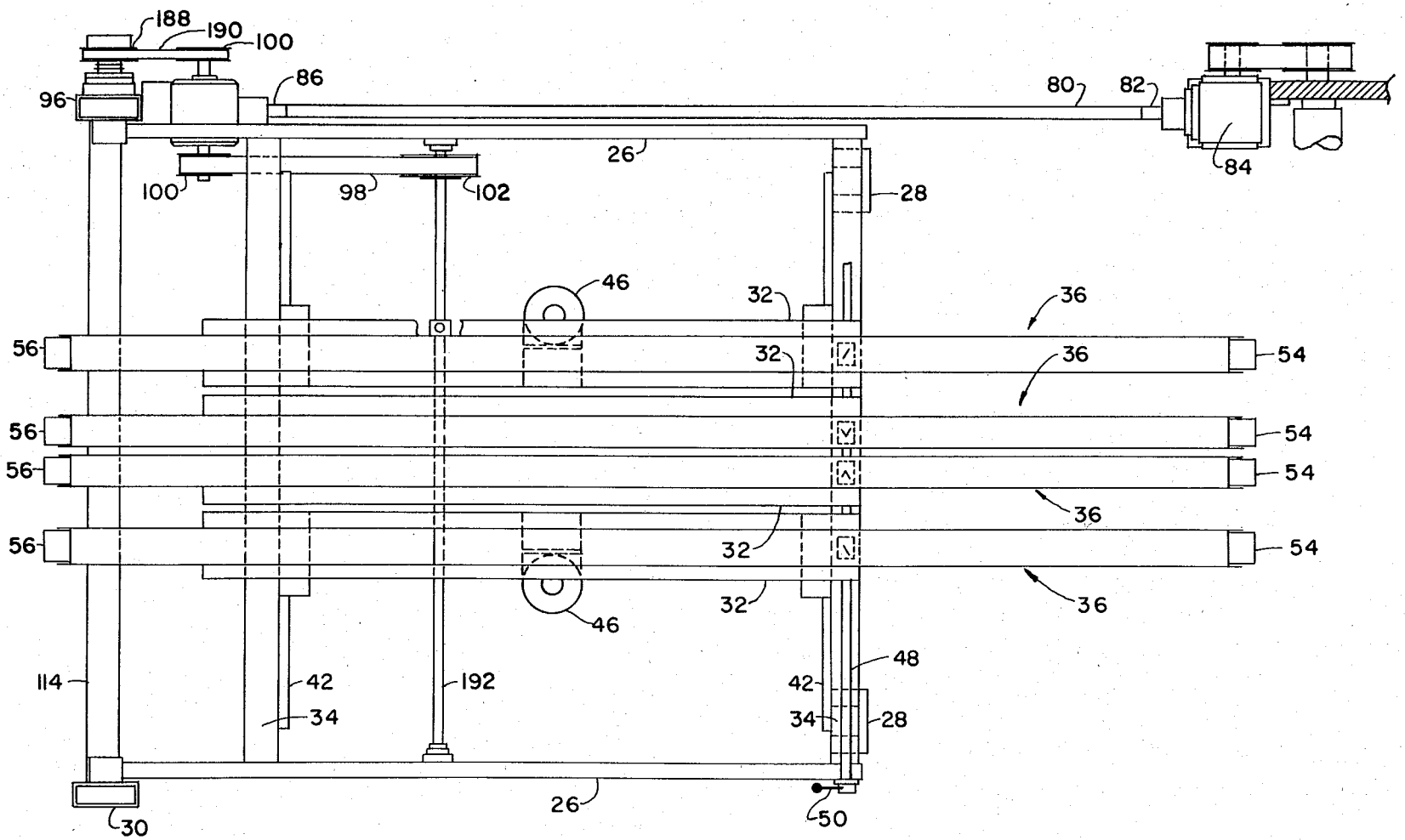
FIG. 5 is a schematic illustration in top view of the inclined conveyor of FIG. 2.
Figure 6:
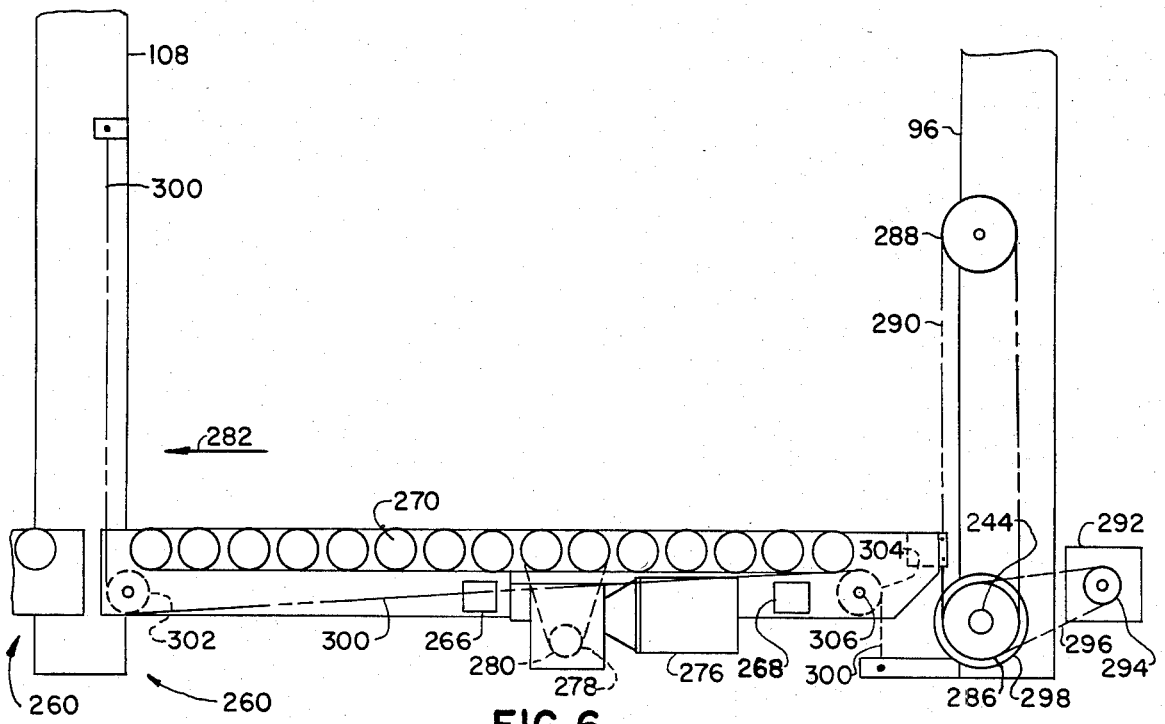
FIG. 6 is a side view in greater detail of the elevator assembly of FIG. 1.
Figure 7:
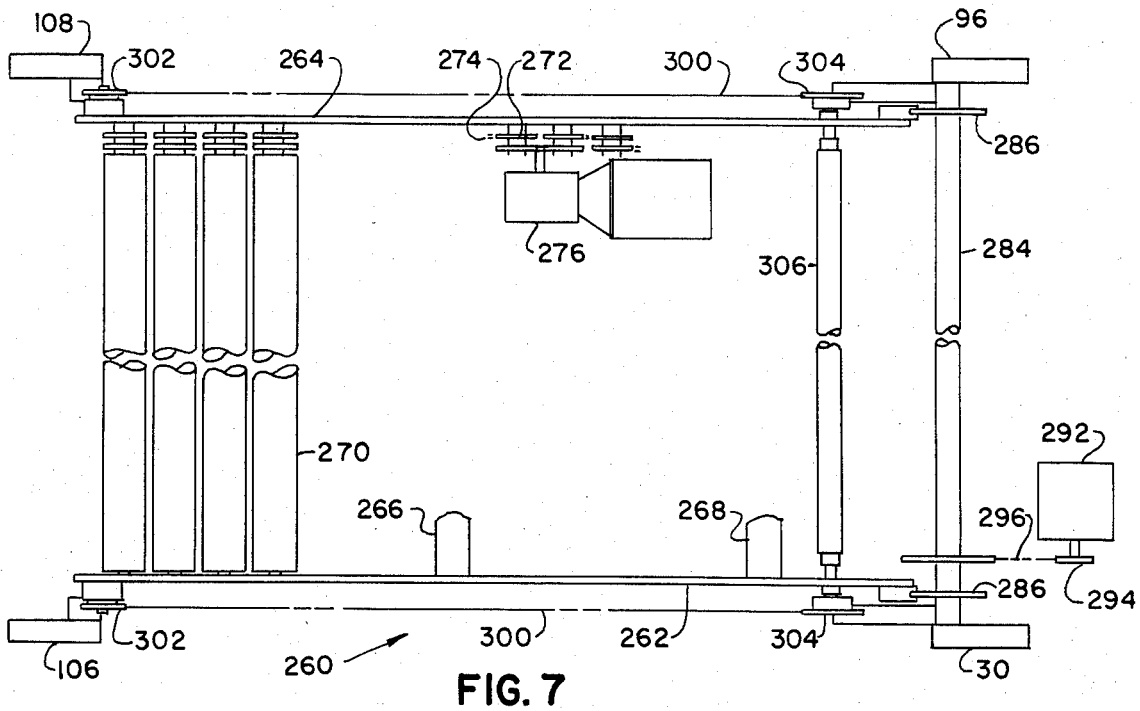
FIG. 7 is a top view of the elevator assembly of FIG. 6.

FIGS. 1 and 2 taken together show the side of the inclined conveyor assembly 12 and FIG. 5 shows the top of the assembly. The assembly includes a substantially rectangular frame 26 supported by upright members 28 near box machine 24 and by upright members 30 and 96 of stacker assembly 10. Four longitudinal supports 32 span the cross members 34 of frame 26. A conveyor subassembly 36 is secured to each of the longitudinal supports 32. The center conveyors 36 are fixed in position but the outboard conveyors 36 are movable toward and away from the center conveyors for positioning under the outboard edges of the blanks 22 being run which may vary in width from order to order. Such movement is accomplished by a conventional rack and pinion arrangement 38 (shown in detail near discharge end-omitted for clarity near input end). In essence, a rack 40 is secured to cross member 34 and a pinion 42 is secured for rotation to longitudinal member 32 (which supports the conveyor 36); rotation of pinion 42 moves the longitudinal member, carrying the conveyor 36, laterally toward or away from the center conveyor. A pinion 42 is secured to each end of a drive shaft 44 which is rotated by a gear motor 46. In this manner, both ends of the conveyor are moved simultaneously.

Four conveyor subassemblies, generally denoted by numeral 36, are used so that two streams of blanks 22 side by side can be stacked. One center conveyor and one outboard conveyor are used for each stream. Of course, a single stream of wide blanks may be advanced by using all four conveyors or a single stream of narrow blanks by using only the two center conveyors.

The conveyors 36 may be skewed to cause separation of the streams of blanks, such streams being formed by slitting a single blank in half in the box machine 24 as well understood by those skilled in the art. The input ends of the two conveyors 36 on each side of the center of conveyor assembly 12 are moved slightly towards the center so that the blanks move apart as they advance to the discharge end. Such movement is accomplished by the use of conventional barrel cams (not shown) on a control shaft 48 which are engaged by a pin (not shown) secured to the longitudinal members 32. Control shaft 48 is turned by handle 50 when the conveyors 36 are to be skewed. The members 32 pivot about a pin 52 secured to the conveyors 36 which extends into the longitudinal member 32 when handle 50 is turned to move the conveyors toward or away from center.

Each conveyor subassembly 36 includes a head pulley 54 and a tail pulley 56 supported for rotation on pins 58 and 60 respectively which pass through the side walls 62 of a box beam 64 at the ends of which the pulleys are mounted. The ends of the box beam are sealed by plates 66 to provide an air-tight interior except for a series of holes 68 (FIG. 11) in the top surface 70 of the beam. A conveyor belt 72 encircles the pulleys 54 and 56, the upper run of which travels along the top surface 70 of the beam 64. Belt 72 includes a series of slots 74 in lateral alignment with the holes 68. Thus, suction pressure from within the box beam 64 is applied to the blanks 22 during their advance by belts 72 to hold them firmly in position to maintain timed sequence of advance of the blanks.

Suction pressure is supplied to the interior of box beams 64 by a conventional motorized blower assembly 76 which sucks air from within the beams 64 through flexible vacuum ducts 78 connected to beams 64 and blower 76. Ducts 78 are flexible to accommodate lateral movement of the individual outboard conveyors 36.

Figure 4:
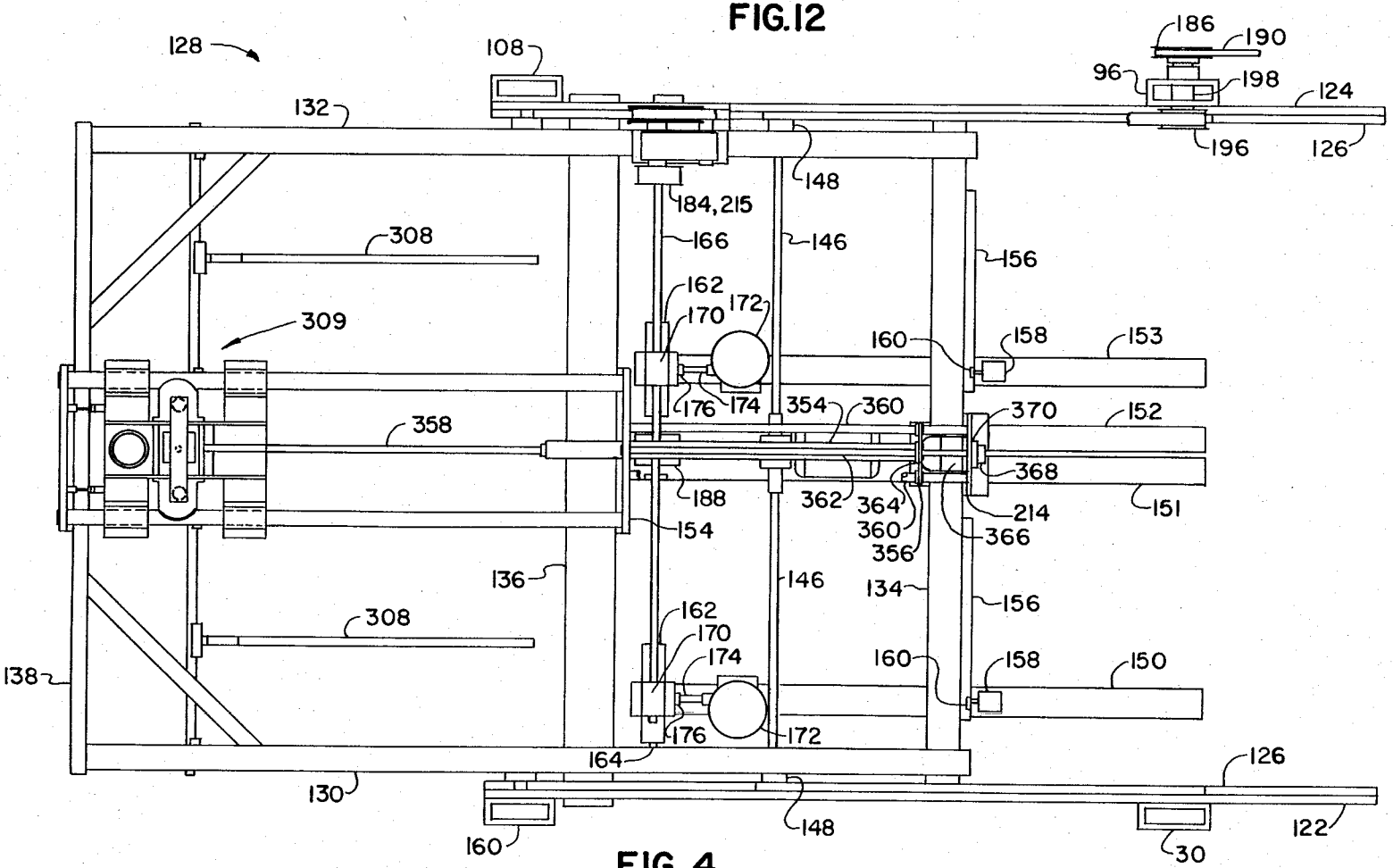
FIG. 4 is a schematic illustration in top view of the timed conveyor and interrupter assemblies of FIG. 1.

The conveyor assembly 12 is driven from the box machine 24 by a line shaft 80 which is connected by a suitable shaft coupling 82 to a gear box 84 which is connected to the box machine in a manner well understood by those skilled in the art. The opposite end of line shaft 80 is connected by a shaft coupling 86 to another gear box 88 mounted to upright member 96 (FIG. 4). Each conveyor subassembly 36 includes a drive pulley 90 keyed to a cross drive shaft 192 and a takeup pulley 94. As shown in FIG. 2, conveyor belt 72 is wrapped around drive pulley 90 and takeup pulley 94 to form a conventional friction drive arrangement. A conventional timing belt 98 connects drive pulley 100 on the gear box 88 to driven pulley 102 on the cross drive shaft 192 to drive the inclined conveyor 12. The gear ratios of the gear boxes 84 and 88 are chosen to cause the surface speed of belts 72 to be equal to the surface speed of the blanks 22 discharged from the box machine 24.

The timed conveyor assembly 14, backstop assembly 16, elevator assembly 18, and interrupter assembly 20 are supported by a frame assembly generally denoted by numeral 104 which includes upright support members 30, 96, 106, and 108. These upright members are connected, across the machine, by angle members 110 and 112 across the bottom. Upright members 30 and 96 are connected by a box beam 114 adjacent the conveyor support frames 26. Upright members 106 and 108 are connected by a box beam bridging member 116.

In the direction of blank flow, denoted by arrow 118 in FIG. 2, the upright members 30 and 106 are connected by plate member 120 along the bottom as shown in FIG. 2 and, on the opposite side, upright members 96 and 108 are connected by a similar plate member 120 (not shown). The upper portions of upright members 30, 106, 96, and 108 are connected by rail members 122 and 124. These rails extend past upright members 30 and 96 toward box machine 24 to accommodate movement of the conveyor assembly 14 as explained below.

Figures 3, 10, 14, 15, 16:
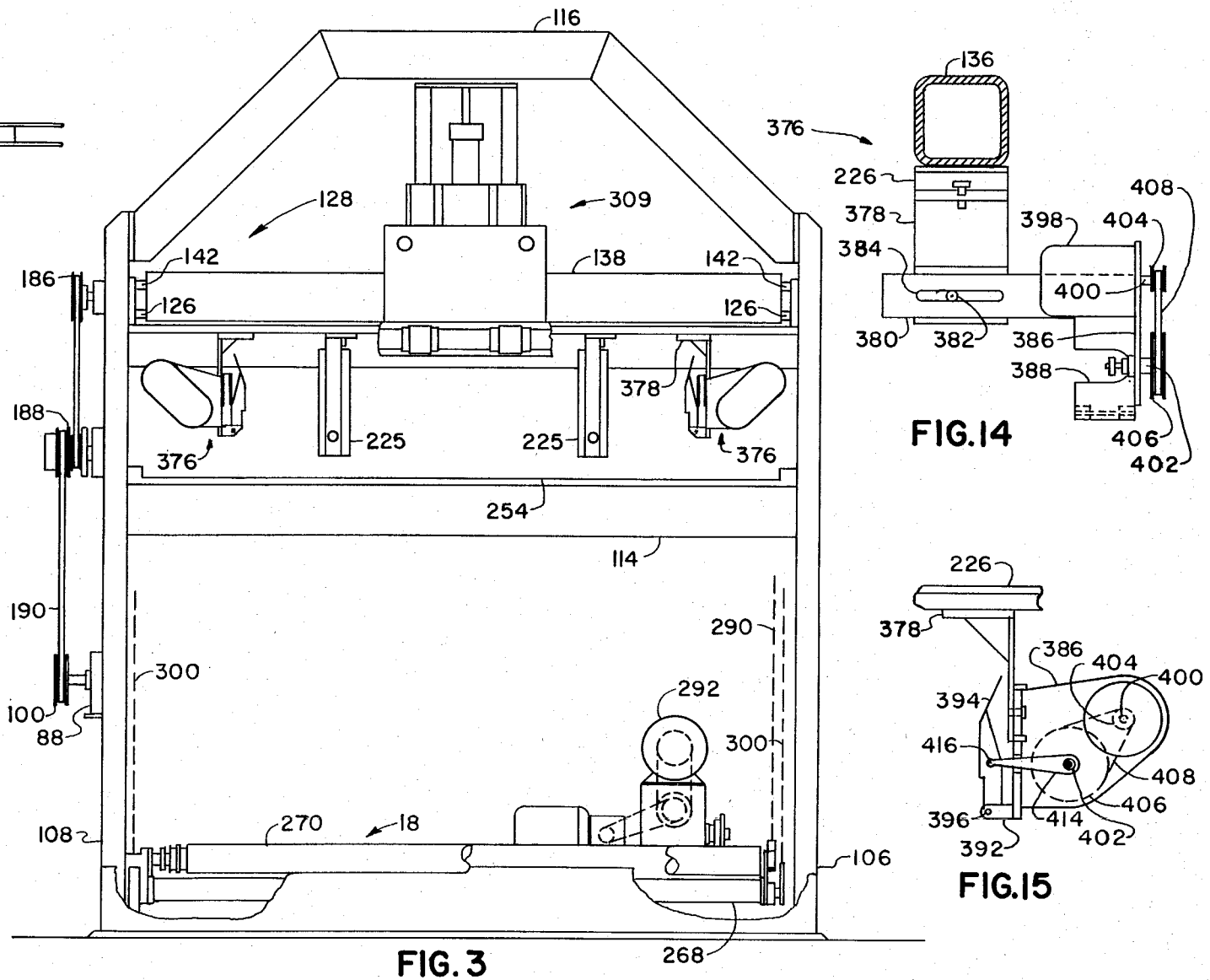
FIG. 3 is a schematic illustration in end elevation of the apparatus of FIG. 1.
FIG. 10 is a side view in greater detail of the tine support for the interrupter assembly of FIG. 1.
FIG. 14 is a side view in greater detail of the spanker assembly shown in FIG. 3.
FIG. 15 is an end view of the spanker assembly of FIG. 14.
FIG. 16 is a side view in greater detail of the individual backstop assemblies shown in FIG. 1.
Figure 12:
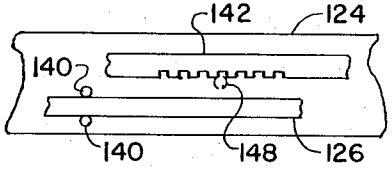
FIG. 12 is a side view of a portion of the movable frame assembly that supports the timed conveyor, backstop and interrupter assemblies of FIG. 1.

The rail members 122 and 124 include guide members 126 secured thereto, as best shown in FIG. 3 and 4, which support a movable frame generally designated by numeral 128. Movable frame 128 supports the timed conveyor assembly 14, backstop assembly 16 and interrupter assembly 20. Movable frame 128 includes longitudinally extending side members 130 and 132 laterally connected by cross members 134, 136, and 138 as best shown in FIG. 4. Frame 138 includes rollers 140 extending from side members 130 and 132, adjacent cross members 134 and 136, for supporting movable frame 128 along the guide members 126 on rail members 122 and 124. A conventional spur-toothed rack 142 is also secured to each rail member 122 and 124 above the guide members 126 (see FIG. 12). A gear motor 144 is mounted to the top of timed conveyor assembly 20; a drive shaft 146 extends from each side of gear motor 144 and each shaft has a spur-toothed pinion 148 mounted on the end thereof in meshing engagement with the rack 142. Rotation of the shafts 146 by gear motor 144 drives the pinions 148 along the racks 142, causing the frame 128 to move in the desired direction, such shafts 146 passing through the side members 130 and 132.

Timed conveyor assembly 14 includes 4 suction conveyor subassemblies 150–153, as best shown in FIG. 4, of which the two center conveyors 151 and 152 are fixed on frame 138; the front portions of such conveyors are secured to cross member 134 and extend beyond such cross member toward the box machine 24. The back ends of the center conveyors 151 and 152 are secured to an upstanding plate 154 which itself is secured to cross member 136. If desired, the two center conveyors 151 and 152 may be made as a single conveyor of a width about equal to two single conveyors.

The two outboard suction conveyor subassemblies 150 and 153 are movable laterally toward and away from the center fixed conveyors 151 and 152 to accommodate various widths and separate streams of blanks as described in connection with the lateral movement of the outboard inclined conveyors 72. To accomplish movement, guide bars 156 are secured to cross member 134; a bracket 158 is secured to each conveyor 150 and 153 and carries a pair of rollers 160 of which one rides on top of guide bar 156 and the other rides beneath. Another bracket 162 is secured to the discharge end of each conveyor 150 and 153. A cross shaft 164 is anchored to each side rail 130 and 132 and passes through brackets 162 which supports the discharge end of the outboard conveyors. Another bracket 168 is secured to the two center conveyors 151 and 152. Cross shaft 164 also passes through this bracket. A spur toothed rack 166 also passes through and is anchored in bracket 168. The rack also passes through brackets 170 anchored to the tops of brackets 162. A gear motor 172 is mounted on top of each outboard conveyor 150 and 153.

Each motor includes an output shaft 174 on the end of which a pinion 176 is mounted so as to be held captive within brackets 170 for meshing engagement with rack 166. Thus, when the pinions 176 are turned by gear motors 172, the outboard conveyors 150 and 153 are caused to move laterally in the desired direction. The gear motors 172 are not essential since the outboard conveyors move easily; therefore, the conveyor may be positioned by hand and a suitable lock provided to lock them in position.

The timed conveyors 150–153 are made in the shape of an inverted u-shaped channel 155 with closed ends and an open bottom. Conventional timing belt pulleys 178 and 179 are secured for rotation in each end as best shown in FIG. 1. A timing belt 180 encircles the pulleys and completes the seal to the interior of the channel although some leakage occurs between the edges of the belt and the side walls of the channel which is not detrimental.

A cross drive shaft 182 is keyed to the head pulley 178 of each conveyor 150–153 and extends to adjacent the far side rail 132 of frame 128 (FIG. 4). Another timing belt pulley 184 is keyed to the end thereof. The drive arrangement for this pulley is shown schematically in FIG. 13. First, a timing belt pulley 186 is mounted for rotation on the upright support 96 (see FIG. 4 also). Pulley 186 is driven by a timing belt pulley 188 located on upright support 96 beneath pulley 186. Pulley 188 is a dual pulley and is itself driven by a timing belt 190 from a pulley 192 on gear box 88. Another pulley 194 is mounted for rotation on side rail 124. Still another pulley 196 is secured for rotation on the inboard side of upright support 96, being driven by a shaft 198 connecting it for rotation with pulley 186. A timing belt 200 encircles pulleys 194 and 196; these pulleys remain fixed since they are secured to fixed members. However, another pulley 202 is fixed to the movable frame 128 and moves with it. As shown in FIG. 13, pulley 202 is in meshing engagement with timing belt 200; an idler pulley 204 also mounted to the movable frame 128 keeps the belt 200 in meshing engagement with pulley 202 as it moves longitudinally with the frame 128. Pulley 202 is also a dual pulley whose inboard pulley portion 205 is encircled by a belt 206 which also encircles pulley 184 on the end of shaft 182 which drives the conveyors 150–153. In this manner, the conveyors can be driven regardless of the position of the frame 128 along the side rails 122 and 124.

Figure 18:
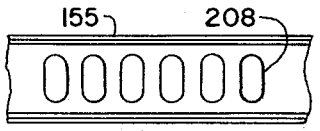
FIG. 18 is a bottom view of the portion of the timed conveyor assembly of FIG. 17.

The timed conveyor belt 180 has a circumference twice the maximum length of the blanks 22 which can be processed by the box machine 24. For example, if the nominal size of the box machine is 66 inches in the direction of the flow of the blanks, then the circumference of the belt 180 is 132 inches. This length is needed because the same place on the belt must engage the leading edge of each succeeding blank. This "place" on the belt is an array of holes 208 (see FIG. 18) or vacuum ports in the belt which engage the leading edge of the blank 22 as it engages the belt 180 as it is discharged by the inclined conveyor 12. Thus, if the array of holes 208 begin at point A (see FIG. 1) on pulley 179 and extend counterclockwise a short distance, preferably about 13 inches, then a second array of holes 208 will begin at point B on pulley 178, again extending counterclockwise. Accordingly, the belt portion extending counterclockwise from point A to point B will engage a first blank and the portion extending counterclockwise from point B to point A will engage a second blank as the belt 180 rotates in a clockwise direction. Therefore, it can be seen that the circumference of the belt should be twice the maximum length of the blank that can be processed. However, if shorter blanks are processed, there will be a space between the blanks as explained in connection with the inclined conveyor assembly 12. This space extends between the trailing edge of one blank and the leading edge of the next; that is, the leading edges will always be in the same position relative to the arrays of holes 208 in belts 180. In this sense, the conveyor 14 is a timed conveyor, being timed with the advance of the blanks 22 being discharged by inclined conveyor assembly 12.

If desired, three arrays of holes 208 may be spaced equidistant around belt 180 which will result in a spacing of 44 inches between arrays when a belt of 132 inches circumference is being used. In this arrangement, the maximum length blank 22 which can be processed will be 44 inches. The speed of belts 180 must be changed by a ratio of 3:2 to maintain the timing sequence. This length is sufficient for most orders run on a 66 inch box machine 24. However, if blanks longer than 44 inches must be processed, then the box machine may be adjusted to feed only one blank for every three feed cycles as will be well understood by those skilled in the art. This will result in succeeding blanks being engaged by the same array of holes 208 in belt 180 and the timed sequence will be maintained.

A conventional blower 210, similar to blower 76 described in connection with inclined conveyor 12, provides suction pressure to the arrays of holes 208 in belts 180 (see FIG. 1). Since the center conveyor subassemblies 151 and 152 remain in fixed lateral position, the connecting duct 212 may be rigid and extends from the blower to the sides of conveyors 151 and 152 so as to withdraw air from between the upper and lower runs of the belts 180. The blower 210 is mounted to a support channel 214 which extends between an upright plate 215 secured to cross member 134 and upright plate 154 secured to cross member 136. Thus, the blower 210 moves longitudinally with the support frame 128. However, since the outboard conveyors 150 and 153 are laterally movable, the blower is connected to them by flexible ducts 218, again being connected to the sides of the conveyors to withdraw air from between the upper and lower runs of the belts 180.

As previously explained, support frame 128 is movable along side rails 122 and 124. The purpose of this is to locate the backstop assembly 16 from a fixed trailing edge backstop assembly, generally designated by numeral 220, at a distance substantially equal to the length of the blank 22 being processed. Doing so causes the blanks to settle evenly on the elevator assembly 18. When the frame 128 is moved toward the fixed stop 220, holes 208 in belts 180 automatically remain in registration with the leading edges of the blanks 22; that is, the holes 208 will be at point A at the time the leading edge of a blank reaches point A. This happens because of the previously described drive arrangement. Referring to FIG. 13, assume that the drive is stopped; thus, timing belt 200 will be stationary. However, as frame 128 moves toward the fixed stop 220, the pulley 202 will roll along the lower run of belt 200 thus turning belt 206 which causes conveyor belt 180 to move the same amount. The result is that holes 208 will remain where they were prior to movement of frame 128. Nevertheless, the pulley 188 includes a conventional clutch arrangement (not shown) that permits pulley 186 to be rotated relative to pulley 196 so that the timed conveyor belts 180 move relative to the drive from the box machine 24. This permits the holes 208 to be moved relative to point A which may sometimes be desirable depending on the irregular configuration of the leading edges of blanks 22.

As pointed out above, the suction pressure in the array of holes 208 in conveyor belts 180 hold the leading edges of the blanks firmly against the belts so that the blanks advance therewith until they are released by the vacuum. In addition, there may be some leakage of vacuum between the edges of belts 180 and the side walls of the individual conveyor channels 155 which tends to cause the entire length of the blanks 22 to adhere to belts 180. This is not desirable for two reasons. First, the blank should be released by the suction pressure as the array of holes 208 comes out of contact with the blank as the holes pass around pulley 178 to permit the blank to settle on elevator 18. If the blank is held by suction pressure along its entire length, it will not settle. In addition, since an oncoming blank of near or maximum length will be very close to the trailing edge of the blank held on the belt 180, the held blank must settle very quickly to prevent its being hit by the oncoming blank. Thus, the trailing edge of the first blank should settle quickly but cannot if it is held to the belt by suction pressure.

Figure 17:
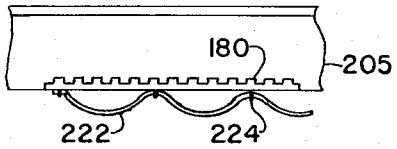
FIG. 17 is a side view in greater detail of a portion of an individual timed conveyor assembly shown in FIG. 1.

Accordingly, belts 180 preferably include a means for holding the trailing edge of the blanks away from the belt. This may be accomplished by securing a piece of foam rubber or the like to the surface of the belt beginning a few inches from the arrays of holes 208 and extending to near the beginning of the next array. However, for durability, it is preferred to secure a standoff piece of semi-rigid material 222, such as polytetraflouroethelene, in serpentine fashion to belts 180 as shown in FIG. 17. Standoff 222 may be secured to the belts by adhesive, staples 224, rivets, or the like. So that the standoff will move satisfactorily around the pulleys 178 and 179, it is secured such that it is flat against the belt as it moves around the pulleys which will result in it being serpentine in shape when the belt moves between the pulleys. The standoff prevents the portion of the blank 22 not held against the belt by suction pressure through holes 208 from being held against the belt by leakage of suction pressure and assures that the trailing portion of the blank will settle before it is hit by an oncoming blank.

The backstop assembly 16 includes several backstop subassemblies 225 fastened to a laterally extending plate 226 secured beneath cross member 136 (see FIG. 1) Plate 226 includes a T-slot as best shown in FIG. 16 into which a matching holder 230 is placed for manual positioning across the length of plate 226, being secured in the desired position by a bolt 232 tightened against the bottom of the T-slot. Holder 230 includes a longitudinally extending slot 234 for supporting another holder 236 depending vertically therefrom and held in position, by a bolt 238 and nut (not shown), on support 230. A flexible vertically extending plate 240 is secured to the bottom end of support 236 and comprises the backstop surface which stops the advance of blanks 22 as they are released by the timed conveyor 14. The front surface of the plate 240 preferably includes a resilient pad 242 of urethane or similar material to prevent damage to the leading edge of the blanks when they impact against the pad. The plate 240, being flexible, bends slightly upon impact and, together with the pad 242, absorbs the shock of stopping advance of the blank. A small commercially available shock absorber 244 is held in a slot 246 in holder 236 by a nut 248 screwed on a threaded portion 250 extending through the slot. A plunger 252 extends from the shock absorber 244 against the back of flexible plate 240 to damp the shock of impact of the blanks against the plate. The shock absorber 244 may be positioned up and down in the slot 246 to vary the amount of flexibility of the plates 240. This arrangement not only absorbs shock to prevent damage to the leading edges of the blanks 22 but also reduces the tendency of the blanks to bounce back toward oncoming blanks which could result in the blanks becoming jammed.

Although only two backstops 225 are shown in FIG. 3, at least two are necessary for stopping wide blanks and four for stopping two narrower blanks. If desired, six may be used to stop three oncoming blanks side by side. Two backstops are required for each oncoming blank having an irregular leading edge; otherwise, only one backstop is needed.

The fixed trailing edge backstop assembly 220 includes a laterally extending flat plate 254 supported by a bracket 256 secured to each of the upright supports 30 and 96. A return flange 258 extends from the top of the plate 254 towards the inclined conveyor 12 to provide a smooth entry surface for the blanks 22 coming into engagement with the timed conveyor 14.

If desired, the fixed trailing edge backstop 220 may be made movable and the movable leading edge backstop 16 may be made fixed. In such arrangement, the frame 128 would be secured directly to the upright supports 30, 96, 106 and 108, there being no need for the side rails 122 and 124 and their associated guide strips and rollers previously described. Instead, similar side rails, strips and rollers would be provided between the uprights at the elevation of the trailing edge backstop 220 to provide for its movement toward a fixed leading edge backstop. The motor 172 and associated rack and pinions would not be needed since the trailing edge backstop is less massive than leading edge backstop. A suitable lock would be provided to hold the trailing edge backstop in the desired position, that is, at a distance from the leading edge backstop substantially equal to the length of the blanks being processed. The adjustment of the leading edge backstop provided by slot 234 in holder 230 (FIG. 16) would remain since this adjustment is needed to place the backstops in positions to engage irregularly-shaped leading edges on the blanks. Of course, if the leading edges are straight, all the backstops would be in alignment across the width of the machine.

The elevator assembly 18 includes a substantially rectangular frame generally denoted by numeral 260 positioned between the two upright supports 30 and 106 on the one side and supports 96 and 108 on the other. Frame 260 has two side rails 262 and 264 joined by cross rails 266 and 268. A plurality of conveyor rollers 270 are bearing mounted for rotation between side rails 262 and 264. A double chain sprocket 272 is keyed to one end of each roller 270. A chain 274 encircles the inner sprockets of two adjacent rollers and another chain 274 encircles the outer sprocket of the rollers and the outer sprocket on the next adjacent rollers and so on to connect all the rollers 270 for driven rotation in the conventional manner. A gear motor 276 is mounted to side rail 264 and includes a drive sprocket 278. A drive chain 280 encircles drive sprocket 278 and two adjacent sprockets 272 so that, upon rotation of the drive sprocket 278, all of the conveyor rollers are driven to discharge a stack of blanks 22 on the rollers 270 from the elevator 18 in the direction of arrow 282. A conventional floor conveyor (not shown) may be provided adjacent the discharge end of elevator 18 to receive the stacks discharged therefrom.

A drive shaft 284 is bearing mounted for rotation between upright supports 30 and 96. A chain sprocket 286 is keyed to each end of shaft 284 just outboard of side rails 202 and 264 respectively. Another chain sprocket 288 is mounted for rotation on upright supports 30 and 96 above the sprockets 286 and in alignment therewith. A chain 290 encircles each pair of sprockets 286 and 288. Chain 290 is divided at the end of side rails 262 and 264 and one end is connected to the top of the rails and the other connected to the bottom. In essence, the side rails become links in the chain so that upon rotation of the chain, the elevator assembly 18 can be raised and lowered. Chain 290 is rotated by a gear motor 292 mounted to angle 110 between uprights 30 and 96. Gear motor 292 includes a chain sprocket 294 connected by a chain 296 to a driven sprocket 298 keyed to drive shaft 284 so that, upon rotation of gear motor 292, lift chains 290 are rotated to raise or lower the elevator assembly 18.

The elevator assembly 18 is held level by a conventional leveling chain arrangement which includes a roller chain 300 having one end anchored to upright support 108 and passing beneath a chain sprocket 302 mounted for rotation on side rail 264 and over the top of another sprocket 304 at the opposite end of rail 264 with the end of the chain 300 anchored to the base of upright support 96. Sprocket 304 is keyed to the end of a cross shaft 306 which extends between the side rails 262 and 264 and is bearing mounted therein. An exact duplicate of the chain and sprocket arrangement is provided on the other side rail 262 and upright supports 30 and 106 with the cross shaft 306 causing the sprockets on both sides of the frame 260 to operate in synchronism. This arrangement supports all four corners of the frame 260 and causes the elevator assembly 18 to remain level during raising and lowering thereof.

The interrupter assembly 20 is best illustrated in FIGS. 1 and 4. It includes a plurality of tines 308 (preferably six, the same as the number of backstops 225 and for the same reason, that is, to accommodate one to three streams of oncoming blanks 22) secured to a tine holder 310. The holder and tines are movable from a first position (shown in solid lines, FIG. 1) to a second lower position beneath the first position shown in dotted lines, then movable to a third position to the left of the second position, also shown in dotted lines, then movable upwardly to a fourth position above the third position and, finally, movable back to the first position.

The tines sit at the first position between the timed conveyors 150–153 above the board line, that is, above the blanks 22 being advanced along the bottom of timed conveyor 14, with the elevator 18 in its uppermost position to receive blanks 22 released from conveyor 14. The elevator 18 descends incrementally as a stack of blanks is formed thereon until it almost reaches its lower most position shown in solid lines on FIG. 1. At that moment, the tines descend swiftly to the second position, just as a blank 22 is released by conveyor 14 and before an oncoming blank can interfere with downward movement of the tines. In this manner, the tines 308 interrupt the flow of blanks 22 downward onto the elevator 18 and the succeeding blanks are stored on top of the tines during the time that the elevator fully descends and discharges the stack of blanks 22 thereon and returns to its uppermost position. Then, the tines 308 move to the third position; as they do so, the blanks 22 stored thereon are restrained from forward movement by the backstops 225 and therefore slide off the tines and onto the elevator 18 which then descends incrementally as described above to form another stack of blanks 22 thereon. Meanwhile, the tines move upwardly from position three to position four above the board line and then move back to the beginning first position to repeat the cycle.

The tines 308 can also be operated to form short stacks or batches of blanks 22 on elevator 18. The stacker apparatus 10 includes an electronic counter (not shown) which counts the number of blanks 22, as they leave the inclined conveyor 12 and beneath the timed conveyor 14, to initiate downward movement of the tines to interrupt stacking of the blanks on the elevator 18. When the desired count has been reached, the tines 308 move downward and begin storing oncoming blanks. Elevator 18 descends to an intermediate discharge position, discharges the blanks and rises to its uppermost position at which time the tines move to the third and then fourth positions as previously described ready to repeat the batching cycle.

At this point, it should be noted that the tines 308 initially move downward from the first position very quickly to just beneath the board line to receive the first of the oncoming blanks 22. Then, they immediately inch downward to the second position at a rate of descent that permits the top of the pile of blanks building thereon to remain at a substantially constant level until the tines reach the second position after which they move to the third position. This arrangement permits the tines 308 to move swiftly past the board line so that the oncoming blanks 22 do not hit them but also keeps the tines from overtaking the downwardly moving elevator 18.

Figure 9:
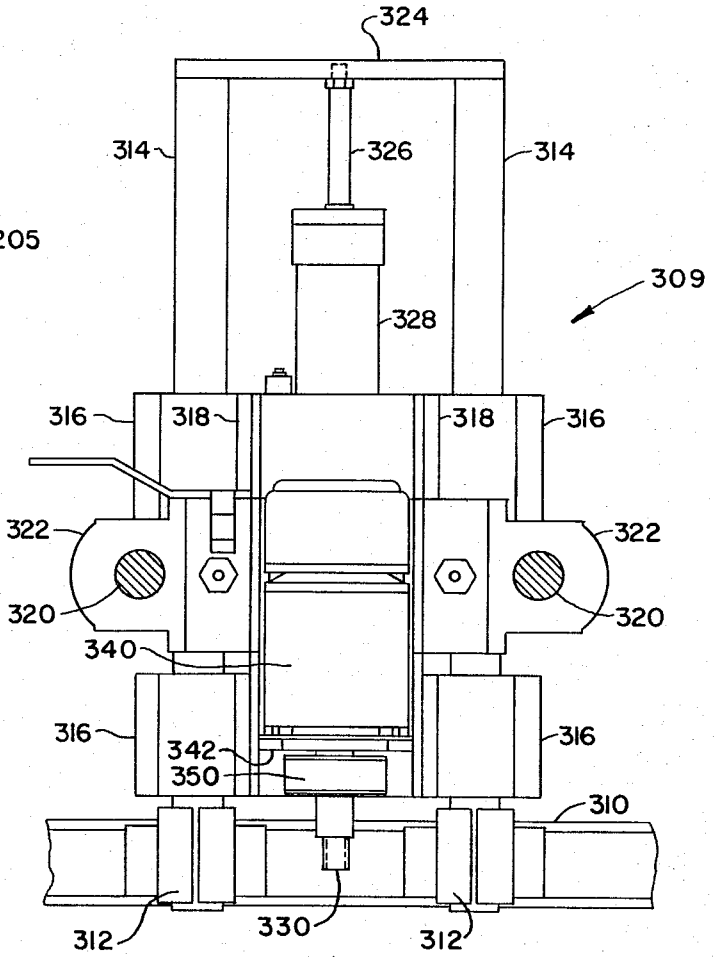
FIG. 9 is an end view of the interrupter support of FIG. 8.
Figure 8:
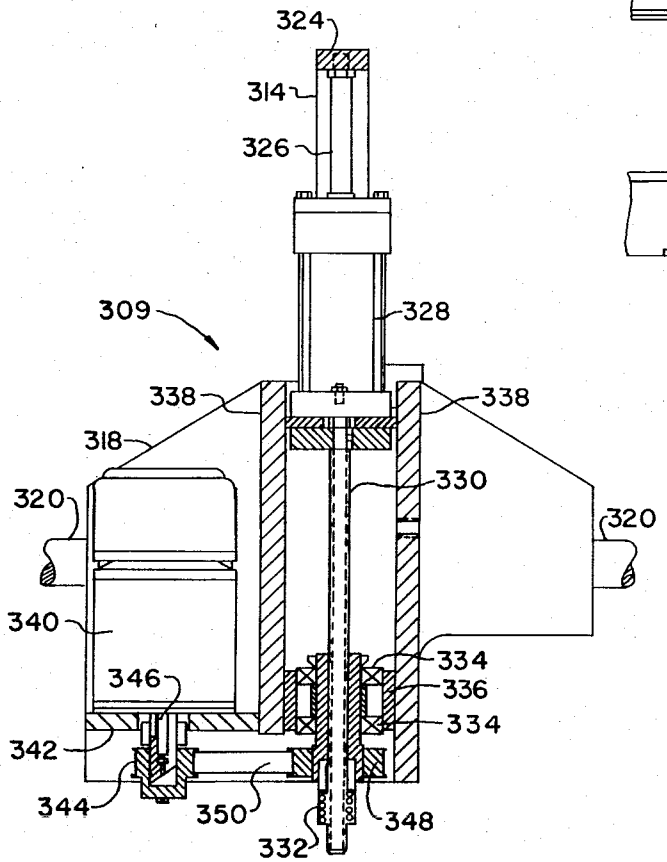
FIG. 8 is a side view in greater detail of the interrupter support assembly of FIG. 1.

The support assembly generally designated by numeral 309 for moving the tines 308 up and down is best illustrated in FIGS. 8, 9 and 10. The tine holder 310 is clamped by clamps 312 to a pair of vertically extending guide rods 314. Rods 314 extend through vertical guide bushings 316 which are themselves secured to upstanding plates 318. Plates 318 are supported on a pair of horizontal guide rods 320 by horizontal guide bushings 322 secured thereto which are used for positioning the tines 308 for blank length as will be explained. The top ends of vertical guide rods 314 are connected by a plate 324 (FIG. 9). The actuator rod 326 of a conventional pneumatic cylinder 328 is connected to plate 324. Thus, as actuator rod 326 is extended and retracted by cylinder 328, the guide rods 314 move up and down thereby moving the guide bar 310, with the tines 308 secured thereto, up and down. The movement of the actuator rod 326 downward from its extended position (shown in FIG. 8) provides the swift movement of the tines 308 from above to below the board line as previously discussed.

Incremental downward movement of the tines 308 is accomplished by mounting the end of the cylinder 328 to the end of a conventional ball screw 330 (FIG. 8). Screw 330 passes through a ball nut 332 which is mounted for rotation in bearings 334. Bearings 334 are mounted in a housing 336 which is secured between a pair of plates 338 which are themselves secured between the upstanding plates 318. When the ball nut 332 is rotated, it causes the ball screw 330 (which is not rotatable) to move up or down, depending on the direction of rotation. Thus, after the actuator rod 326 has moved the tines 308 swiftly downward, by an amount equal to the stroke of the actuator rod, the ball screw 330 is rotated a preselected number of turns to inch the tines 308 downward the desired distance to accommodate the blanks 22 being stored on the tines. It can be seen that, as the ball screw 330 moves downward, it carries the cylinder 328 with it; since the actuator rod is connected to the guide rods 314, as previously explained, the tine holder 310 secured to the rods moves downward also.

Rotation of the ball nut 332 is provided by a motor 340 mounted on a support plate 342 which is secured to one of the plates 338. A conventional timing belt pulley 344 is keyed to the output shaft 346 of the motor 340 and another pulley 348 is keyed to the ball nut 332. A timing belt 350 encircles the pulleys 344 and 348 to rotate the ball nut 332 upon rotation of the motor.

Horizontal movement of the tine support assembly 309 is accomplished by moving it along the horizontal guide rods 320 as best shown in FIG. 1. Guide rods 320 are held in place between upright support plate 154, which is secured to the cross member 136 of frame 128 as previously explained, and another upright plate 352 secured to cross member 138. The top view of FIG. 4 shows the path of movement of support assembly 309 between plates 154 and 352.

Horizontal movement of support assembly 309 is provided by a conventional pneumatic cylinder 354 (FIG. 4) whose one end is secured to a plate 356 and whose other end extends for sliding movement through upstanding plate 154. The actuator rod 358 of cylinder 354 is connected to support assembly 309 so that, upon actuation of rod 358, the assembly, with the tines 308 attached, are caused to move from the fourth position (previously described) to the first position and from the second position to the third position depending on the direction of movement of the actuator rod 358.

As previously mentioned, the interrupter tine assembly 20 may be omitted if desired. To provide interruption of the stacking of blanks 22 on the elevator assembly 18 during discharge of a stack of blanks therefrom, the advance of blanks from the box machine 24 may be interrupted so that there are no blanks being released by the timed conveyor assembly 14 during such time. This is accomplished by utilizing the stop-feed apparatus (not shown) conventionally used on many box machines. Such stop-feed apparatus usually employs pneumatic cylinders connected to a plate which, when operated, lifts the trailing edge of the blanks, being fed from a feed table, above a reciprocating feeder bar so that the feeder bar does not engage the trailing edges of the blanks. The pneumatic cylinders are operated by conventional electric push button switches, both near and remote from the cylinders. Thus, in the event of a jam or other reason, the operator may quickly stop feeding of the blanks simply by pushing a button.

To utilize this arrangement for interrupting stacking of the blanks on the elevator, it is necessary only to use a conventional sensor (such as an electric eye - not shown) to sense when the height of the stack of blanks 22 on the elevator assembly 18 has reached a preselected height. The sensor is wired in parallel with the push buttons for the pneumatic cylinders so that, when the predetermined stack height is reached, a signal from the sensor operates the pneumatic cylinders to raise the trailing edge of the stack on the feed table so that feeding of the blanks is stopped. Consequently, no blanks are supplied to the timed conveyor 14 during such time as the stop-feed is operated and, thus, stacking of blanks 22 on the elevator 18 is interrupted. When the stack of blanks is discharged from the elevator, another sensor (not shown), which is also used to signal the elevator to return to its uppermost position, sends a signal to the pneumatic cylinders causing them to lower the stack to the feed position so that blanks are again supplied to the timed conveyor 14. If necessary, a signal may be sent to the cylinders prior to the stack being discharged so that blanks will have reached the timed conveyor by the time the elevator reaches its uppermost position. One skilled in the art can readily arrange the timing of the signals to provide a substantially continuous supply of blanks to the timed conveyor 14 so that stacking of the blanks 22 on the elevator assembly 18 is interrupted only for the time needed to discharge the stack therefrom.

When short stacks or batches of blanks are to be discharged, as previously mentioned and more particularly explained later, a signal from a blank counter used to determine the number of blanks in such short stacks can be used to provide a signal to the stop-feed pneumatic cylinders to provide the same interruption of stacking of blanks on the elevator.

Referring now to FIG. 1, the leading edge backstop assembly 16 must be moved toward the trailing edge backstop assembly 220 for shorter length blanks which may be as short as 14 inches on a 66 inch nominal size box machine 24. Backstop assembly 16 is moved by moving the frame assembly 128, toward the backstop assembly 220, along side rails 122 and 124 by gear motor 144 as previously explained. Movement of the frame 128 carries with it all of the various assemblies mounted to it, including the interrupter assembly 20. It can be seen that, when the backstop assembly 16 is moved toward the backstop assembly 220 to accommodate shorter blanks, the tips of the tines 308 would overlie the trailing edge backstop assembly 220 and would prevent downward movement of the tines 308 to the second position previously described. To prevent this, the air cylinder 354 is moved to the left, as viewed in FIG. 1 and 4, as the frame 128 is moved to the right to place the tines 308 in the desired position. This is accomplished by mounting the support plate 356 for cylinder 354 for sliding movement on a pair guide bars 360 which extend between and are connected to upright support plates 214 and 154. Thus, movement of air cylinder support plate 356 to the left along guide rods 360 carries the cylinder and consequently, the tine support assembly 309 and tines 308 to the left. Cylinder support plate 356 is moved by a conventional ball screw 362 which extends between upright support plates 214 and 154 and is supported for rotation therein; ball screw 362 also passes through a conventional ball nut 364 mounted in cylinder support plate 356. Thus, as ball screw 362 is rotated, the cylinder 354 is moved to the right or to the left. Ball screw 354 is rotated by a motor 366 mounted to upright plate 214 so that its drive shaft 368 extends therethrough. A timing belt pulley 370 is keyed to drive shaft 368 and another timing belt pulley 372 (FIG. 1) is keyed to the end of ball screw 362 extending through plate 214. A timing belt 374 encircles the pulleys and rotates ball screw 362 upon rotation of motor 366.

As previously mentioned, the leading and trailing edge backstop assemblies 16 and 220 guide the blanks 22 as they settle on the elevator assembly 18 to form a stack of blanks whose leading and trailing edges are in substantially even alignment which is desirable for subsequent handling of the stacks. It is also desirable to have the side edges of the blanks in even alignment. This is accomplished by providing a spanker assembly generally denoted by numeral 376 on both sides of the stack as best shown in FIG. 3. Referring to FIG. 14 and 15, each assembly 376 includes a support bracket 378 mounted in the cross member 226 which supports the backstop assemblies 225. A horizontal support bracket 380 is slidably secured on bracket 378 by means of a bolt 382 passing through a slot 384 and into bracket 380. This arrangement provides for horizontal positioning of the assembly 376 so that straightening of the side edges of the blanks 22 occurs nearer their center rather than at their leading edges. An angle bracket 386 depends from horizontal bracket 380 and includes one leg 388 in the same plane as bracket 380 and another leg 390 at a right angle thereto. It also includes a pair of lugs 392 extending toward the blanks 22 as best shown in FIG. 3. A spanker plate 394 is pivotally mounted between the lugs 392 by a pin 396. A motor 398 is mounted on leg 390 of angle bracket 386 with its drive shaft 400 extending therethrough (FIG. 14). A crank pin 402 is also bearing mounted in leg 386 adjacent the motor 398. A timing belt pulley 404 is keyed to motor shaft 400 and another timing belt pulley 406 is keyed to crank pin 402. A timing belt 408 encircles these pulleys to rotate the crank pin 402 by motor 398. A crank wheel 410 is keyed to the opposite end of crank pin 402 and includes a drive pin 412. A connecting rod 414 connects drive pin 412 to a connecting pin 416 on spanker plate 394. Thus, as crank wheel 410 rotates, the spanker plate 394 is caused to pivot about pivot pin 396. The assembly 376 is positioned laterally in the T-slot 228 so that the spanker plate 394 is in vertical alignment with the sides of the stack of blanks 22 to be formed on elevator assembly 18. The top portion of the spanker plate 394 moves away from such vertical alignment during rotation of crank wheel 410 to impart a spanking motion to the sides of the stack to urge the side edges of the blanks 22 into even alignment.

OPERATION

To operate the stacker assembly 10, the outboard inclined conveyors 36 of inclined conveyor assembly 12 are positioned across the width of the assembly to accommodate the width of blanks 22 to be stacked. If two, or even three, streams of blanks are to be stacked, the entrance ends of the conveyors 36 are skewed to separate the side edges of the blanks 22 as previously explained by turning the handle 50 to rotate the barrel cams (not shown) on shaft 48.

The outboard timed conveyors 150 and 153 are placed substantially in lateral alignment with the inclined conveyors 36. The frame 128 is moved by motor 144 toward or away from the fixed backstop assembly 220 to position the backstop assembly 16 so that the leading edge backstops 225 are at a distance corresponding to the length of blanks 22, or slightly greater, from backstop plate 254. The interrupter assembly 309 is positioned, by actuation of motor 366, so that the ends of the tines 308 do not overlie the backstop plate 254 when the tines are in the first position above the board line as previously described.

The backstop assemblies 225 are positioned, using motors 172, to place two backstops in the paths of each stream of advancing blanks 22. The side spanker assemblies 376 are moved manually in the cross member 226 to place the spanker plates 394 in lateral alignment with the sides of the stack of blanks 22 to be stacked on elevator assembly 18.

The elevator assembly 18 is raised to its uppermost position by motor 292 to receive blanks 22 released from the timed conveyor assembly 14. The blowers 76 and 210 are turned on to supply vacuum to the inclined conveyors 36 and timed conveyors 150–153 respectively.

The box machine 24 is turned on which also causes the inclined conveyors 36 and timed conveyors 150–153 to rotate. The blanks 22 supplied by the box machine 24 advance along inclined conveyors 36 and adhere thereto in timed sequence and into contact with timed conveyors 151–153. The blanks 22 advance beneath conveyors 151–153 and adhere thereto by virtue of the suction pressure through the holes 208 in belts 180 until the holes begin to turn around pulley 178 thereby blocking off the vacuum and releasing the blank whose forward inertia carries it against the backstops 225 which absorb the shock of impact as previously explained. The blanks 22 settle upon conveyor assembly 18 which inches downward as a stack of blanks 22 is formed thereon. The side spanker assemblies 376 align the side edges of the blanks as they settle upon the conveyor.

As the stack of blanks 22 forms on elevator 18, it is caused to inch slowly downward until it almost reaches its lowermost position at which time the tines 308 descend swiftly to just beneath the board line to intercept and store the succeeding oncoming blanks. At the same time, elevator 18 descends to its lowermost position and the rollers 270 on elevator 18 begin rotating to discharge the stack. After the stack is discharged, elevator 18 returns to its uppermost position; tines 308 move to the third position and the accumulation of blanks 22 thereon settle onto the elevator which begins to inch downward again. Meanwhile the tines 308 move through the fourth position and back to the first position to begin the next cycle.

The stacker 10 may be operated manually with the assistance of pushbuttons to control operation of the various motors and pneumatic cylinders. However, more fully automatic operation is desirable and may be accomplished by the use of conventional photocells and limit switches, the application of which may be easily done by one skilled in the art. For example, as the blanks 22 form a stack upon the elevator 18, the height of the stack will rise to where it blocks the beam of a photocell (not shown). An electric signal from such blockage is used to turn the gear motor 292 causing the elevator 18 to lower slowly until the top of the stack uncovers the beam from a lower mounted photocell. Uncovering such beam provides a signal to stop gear motor 292. This stop and go downward cycle continues until the elevator reaches its lowermost position where it trips a limit switch (not shown) which provides an electric signal to first cause the tines 308 to descend swiftly below the board line to interrupt the settling of blanks 22 upon the elevator 18 and then to start gear motor 276 to rotate rollers 270 on the elevator 18 to discharge the stack of blanks therefrom. As the stack clears the elevator 18, it uncovers another photocell which provides a signal to stop rotation of the elevator rollers 270 and causes the elevator to rise to its uppermost position. As the elevator reaches its uppermost position, it trips a limit switch (not shown) which stops upward movement of the elevator and signals the tines 308 to withdraw, thereby depositing the stored blanks 22 upon the waiting elevator to start the next stacking cycle as subsequently advancing blanks are released by the timed conveyor 14 and settle thereon. Meanwhile, the tines 308 are caused to move from their withdrawn third position through the fourth position and to their first waiting position ready to interrupt the flow of blanks 22 when the elevator 18 reaches its discharge position.

As previously mentioned, the use of the tine assembly 20 is not essential to interrupt the stacking of blanks 22 on elevator assembly 18. Instead, interruption of stacking may be accomplished by utilizing the stop-feed arrangement previously described. Such stop-feed is arranged so that blanks 22 are not present on the timed conveyor 14 at such time as the stack of blanks on elevator assembly 18 is being discharged but will be present when the elevator reaches its uppermost position again ready to receive blanks thereon.

The stacking mode of operation described above can be changed to stack batches rather than full stacks of blanks 22 on elevator 18 since it is often desirable to form short stacks of preselected numbers of blanks. In the batching mode, a blank counter (not shown) is placed in the path of flow of blanks 22 such as where they leave the inclined conveyor 12 and enter beneath the timed conveyor 14. When the blank counter reaches a dialed-in count, it provides a signal to the tines to descend to the second position beneath the board line and to the elevator to lower it to a discharge position. When batch stacking, the batches are preferably discharged at a height above the elevator's lowermost position. A discharge conveyor 420 which can be raised to the desired height can be provided adjacent the discharge side of the elevator in which case, the elevator 18 descends to the proper height to discharge the batch onto such discharge conveyor. The limit switch used to signal when the elevator is in its lowermost position is movable to the correct position to stop downward movement of the elevator when it reaches the level of the discharge conveyor. Otherwise, the other aforementioned photocells and limit switches perform in substantially the same manner.

One skilled in the art can also provide logic circuits to prevent operation of certain elements if they are not in their proper position. Just as one example, the tines 308 can be prevented from being lowered if they are not in their first starting position. Other such circuits may be provided for similar purposes.

As previously mentioned, the array of holes 208 in the timed conveyor belts 180 come into contact with the leading edges of the blanks 22 as they enter beneath the timed conveyors 150–153. The array of holes 208 will begin to peel off the blank, as the belt 180 turns around tail pulley 178, just as the leading edge of the blank hits the backstops 225. In some instances, the vacuum holding the blank to the belts 180 may be too much, or the characteristics of the blank may be such, so that the blank does not settle freely on the elevator 18. In other instances, the blank may release too soon so that it desirable to hold the blank against the belts 180 for a longer time to get the blanks to settle properly. In such instances, the position of the array of holes 208 may be changed relative to the leading edge of the blank. This is accomplished by disengaging the belts 180 from the drive train described in connection with FIG. 13. The clutch (not shown) associated with the pulley 188, when disengaged, permits the belts 180 to be rotated relative to the drive train (which also advances the blanks as described) so that the array of holes 208 may be moved relative to the leading edge of the blanks. Thus, the array of holes 208 may be advanced so that the leading ones are not in contact with the blank and the blank will be held less firmly by vacuum in the remaining holes. Or, the array of holes may be moved backward so that vacuum is applied to the blank even after the leading edge has hit the backstops 225. In this instance, the belts 180 will wipe across the blank until the array of holes 208 peel off as the belts 180 turn around the pulleys 178 thereby keeping the blank 22 pressed against the backstops 225 before being released to settle upon the elevator 18. In this specification and claims the term "upon release by the timed conveyor" and words of similar import mean release before, at the same time, or after the leading edge of the blank 22 engages the backstops 225. In addition, "engagement of the vacuum ports 208 with the leading edge of blanks" and words of similar import mean that the first of the ports may be even with the leading edge or ahead or behind it.

The inclined conveyor assembly 12 is inclined to carry the blanks 22 from the level at which they are discharged from the machine 24 to the higher level of the timed conveyor assembly 14 to provide the space necessary to form a stack of blanks 22 on elevator assembly 18. However, the conveyor assembly 12 need not be inclined in all circumstances. For example, the height of the box machine may be raised level with the timed conveyor assembly 14 or the structure supporting the timed conveyor may be placed in a pit to lower the timed conveyors level with the box machine. Actually, when the timed conveyors are level with the box machine, either by raising the box machine or by lowering the conveyors, the inclined conveyor assembly 12 may be omitted and the blanks 22 fed directly from the box machine 24 to the timed conveyor assembly 14. The only requirement is that the blanks advance serially in timed sequence which they do when discharged from conventional box machines.

Although the apparatus has been described in connection with the production of corrugated paperboard blanks or sheets, it also functions equally well when stacking blanks of folding carton stock (sometimes known as pasteboard) or when stacking solid fibre blanks (similar to corrugated blanks except that the inner medium is laminated flat sheets rather than a corrugated medium). In addition, the apparatus may also be used to stack blanks made from various types of plastics and other semi-rigid materials such as asphalt impregnated paper and felt, cork, and textiles.

Box blanks are often stacked on pallets for material handling purposes. Such pallets aay be placed on top of the rollers 270 of the elevator assembly 18 and the blanks will stack on the pallets in the same manner as on the rollers. Thus, when the rollers 270 are rotated, the stack will be discharged on the pallet for further handling.

Therefore, the invention having been described in its best embodiment and mode of operation, that which is desired to be claimed by Letters Patent is:

1. Apparatus for stacking blanks comprising in combination:

timed conveyor means for serially advancing and releasing said blanks from beneath a lower run of said conveyor means, said timed conveyor means including a plurality of laterally spaced conveyor belt means having a circumference substantially equal to twice the maximum length of said blanks that can be processed by said apparatus and having at least two arrays of vacuum ports therein spaced substantially equidistant around said circumference and adapted for engagement with leading edges of said blanks for causing said blanks to adhere to said belt means during advancement thereof, said conveyor belt means further including a standoff portion extending substantially between said arrays of vacuum ports for preventing the portion of said blanks not adhering to said arrays from adhering to said conveyor belt means;

backstop means adjacent a discharge end of said conveyor means for stopping the advance of said blanks upon their release by said conveyor means; and receiving means beneath said conveyor means upon which said blanks are stacked following release by said conveyor means.

2. The apparatus of claim 1 wherein:

said timed conveyor means include at least one center conveyor belt means fixed in the lateral center of said apparatus and at least one outboard conveyor belt means on each side of said center conveyor belt means, said outboard conveyor belt means being movable laterally toward and away from said center conveyor belt means.

3. The apparatus of claim 1 wherein:

said timed conveyor belt means have at least three arrays of said vacuum ports spaced substantially equidistant around said circumference.

4. The apparatus of claim 1 wherein:

said backstop means includes laterally spaced first and second backstop members each of which is individually adjustable toward a leading edge of said blanks for engaging irregular-shaped leading edges of said blanks.

5. The apparatus of claim 4 wherein:

said first and second backstop members include resilient means for absorbing the impact of said blanks advancing against said backstop means.

6. The apparatus of claim 4 wherein:

said backstop means is adjustable toward a trailing-edge backstop means to control the position of said blanks following release thereof by said timed conveyor means.

7. The apparatus of claim 4 further including:

a trailing-edge backstop means adjustable toward said backstop means to control the position of said blanks following release thereof by said timed conveyor means.

8. The apparatus of claim 1 further including:

interrupter means for interrupting the release of said blanks by said timed conveyor means during such time as a stack of said blanks formed on said receiving means is discharged therefrom.

9. The apparatus of claim 8 wherein:

said interrupter means comprises stop-feed means for interrupting the advance of said blanks to said timed conveyor means.

10. The apparatus of claim 8 wherein:

said interrupter means comprises stack interrupter means movable between said timed conveyor means and said receiving means for storing said blanks subsequently released by said timed conveyor means during such time as a stack of said blanks formed on said receiving means is discharged therefrom.

11. The apparatus of claim 10 wherein:

said stack interrupter means includes a plurality of tine means supported adjacent a discharge end of said timed conveyor means and movable from a first position out of engagement with said blanks released by said timed conveyor means to a second position beneath said timed conveyor means for intercepting and storing blanks released by said timed conveyor means during such time as a stack of blanks on said receiving means is discharged therefrom.

12. The apparatus of claim 11 further including:

counter means for energizing said interrupter means upon the release of a predetermined number of said blanks by said timed conveyor means to form a stack of a predetermined number of said blanks upon said receiving means.

13. The apparatus of claim 1 wherein:

said receiving means comprises a discharge conveyor means beneath said timed conveyor means for receiving said blanks released by said timed conveyor means to form batches of said blanks thereon.

14. The apparatus of claim 13 wherein:

said discharge conveyor means includes conveyor drive means for rotating a plurality of rollers of said discharge conveyor means to discharge said batches from said discharge conveyor means.

15. The apparatus of claim 14 wherein:

said conveyor drive means is operable in response to an interrupter means for said timed conveyor means for discharging said batches from said discharge conveyor means during such time as release of said blanks by said timed conveyor means is interrupted.

16. The apparatus of claim 15 further including:

counter means for energizing said interrupter means upon the release of a predetermined number of said blanks by said timed conveyor means to form a stack of a predetermined number of said blanks upon said discharge conveyor means.

17. The apparatus of claim 1 wherein:

said receiving means comprises an elevator means movable from an upper position beneath said timed conveyor means to a lower position beneath said timed conveyor means for discharging stacks of said blanks formed thereon.

18. The apparatus of claim 17 wherein:

said elevator means is movable incrementally from said upper position to said lower position in response to the height of a stack of said blanks thereon for maintaining the distance between the top of said stack and said timed conveyor means within predetermined limits.

19. The apparatus of claim 18 wherein:

said elevator means includes powered conveyor rollers operative, upon said elevator means reaching said lower position, to discharge a stack of blanks thereon and thereafter return to said upper position.

20. The apparatus of claim 1 further including:

inclined conveyor means having an output end adjacent an input end of said timed conveyor means for serially advancing said blanks on said inclined conveyor means into operative engagement with said timed conveyor means.

21. The apparatus of claim 20 wherein:

said inclined conveyor means includes a plurality of laterally spaced conveyor belt means against which said blanks are held for positive advancement by suction pressure applied to said blanks through said conveyor belt means.

22. The apparatus of claim 21 wherein:

outer ones of said conveyor belt means are selectively adjustable at an angle to the path of advance of said blanks for laterally separating at least two streams of said blanks advancing side by side along said inclined conveyor means.

23. Apparatus for the continuous stacking of paperboard blanks comprising in combination:

timed conveyor means for serially advancing and releasing said blanks from beneath said conveyor means, said conveyor means including:

a plurality of laterally spaced conveyor belts having a circumference at least twice the maximum length of said blanks and having at least two arrays of vacuum ports therein spaced equidistant around said circumference for applying suction pressure to succeeding ones of said blanks causing the same to adhere to lower runs of said belts;

backstop means adjacent to a discharge end of said timed conveyor means for stopping the advance of said blanks upon their release by said conveyor means, said backstop means including:

a plurality of laterally spaced backstop members each of which is individually adjustable toward a leading edge of said blanks for engaging irregular-shaped leading edges of said blanks;

elevator means beneath said timed conveyor means upon which said blanks are stacked as they are released by said conveyor means, said elevator means being movable from an upper position to a lower position beneath said timed conveyor means in response to the height of a stack of said blanks thereon for maintaining the distance between the top of said stack and said lower run of said conveyor belts within predetermined limits, said elevator means including;

powered conveyor rollers operative in response to said elevator means reaching said lower position to discharge said stack of blanks thereon, said elevator means adapted to return to said upper position following discharge of said stack;

interrupter means including a plurality of tine means supported in a first position out of engagement with said blanks being released by said conveyor means and movable to a second position beneath said timed conveyor means and above said elevator means for intercepting blanks released by said timed conveyor means during such time as a stack of blanks on said elevator means is being discharged therefrom; and a trailing edge backstop means supported adjacent the trailing edges of said blanks being released by said timed conveyor means and being adjustable toward a trailing edge of said blanks to accommodate blanks of selected lengths.

24. The apparatus of claim 23 further including:

inclined conveyor means having a plurality of laterally spaced conveyor belts through which suction pressure is applied to said blanks for advancing the same into operative engagement with an input end of said timed conveyor means.

* * * * *